US006796351B1

(12) United States Patent
Maeda

(10) Patent No.: US 6,796,351 B1
(45) Date of Patent: Sep. 28, 2004

(54) TAPE APPLICATION DEVICE

(75) Inventor: Tsuyoshi Maeda, Tokyo (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 10/381,456

(22) PCT Filed: Sep. 26, 2000

(86) PCT No.: PCT/JP00/06607

§ 371 (c)(1),
(2), (4) Date: Mar. 26, 2003

(87) PCT Pub. No.: WO02/26553

PCT Pub. Date: Apr. 4, 2002

(51) Int. Cl.[7] ..... B32B 31/20; B65C 9/00; B44C 1/16; B44C 7/00; C09J 7/02

(52) U.S. Cl. ..... 156/391; 156/486; 156/540; 156/574; 156/579

(58) Field of Search ..... 156/391, 443, 156/459, 475, 486, 523, 537, 540, 543, 574, 576, 577, 581, 582, 579, 71

(56) References Cited

U.S. PATENT DOCUMENTS

| | | | | |
|---|---|---|---|---|
| 2,916,079 A | * | 12/1959 | Schiefer | 156/391 |
| 4,075,053 A | * | 2/1978 | Adams | 156/391 |
| 4,174,246 A | * | 11/1979 | Ralston | 156/391 |
| 4,715,110 A | | 12/1987 | St. Angelo et al. | |
| 4,760,636 A | | 8/1988 | St. Angelo, Jr. et al. | |
| 6,098,685 A | * | 8/2000 | Maeda | 156/391 |
| 6,508,287 B1 | * | 1/2003 | Shinozaki et al. | 156/391 |
| 6,585,023 B2 | * | 7/2003 | Azuhata | 156/574 |
| 6,601,630 B2 | * | 8/2003 | Kang | 156/574 |
| 6,698,489 B1 | * | 3/2004 | Shinozaki et al. | 156/574 |

FOREIGN PATENT DOCUMENTS

| | | | | |
|---|---|---|---|---|
| GB | 2 227 779 A | | 8/1990 | |
| GB | 2 238 339 A | | 5/1991 | |
| JP | 51-135015 | | 11/1976 | |
| JP | 62-46780 | | 2/1987 | |
| JP | 63-84832 | | 4/1988 | |
| JP | 2-221582 | | 9/1990 | |
| JP | 3-166068 | | 7/1991 | |
| JP | 5-65298 | | 9/1993 | |
| JP | 5-338627 | | 12/1993 | |
| JP | 11-147658 | * | 6/1999 | B65H/35/07 |
| JP | 2000-118322 | | 4/2000 | |
| JP | 2000-159165 | | 6/2000 | |

* cited by examiner

*Primary Examiner*—Jerry A. Lorengo
(74) *Attorney, Agent, or Firm*—Finnegan, Henderson, Farabow, Garrett & Dunner, LLP

(57) ABSTRACT

A tape application device according to the present invention is provided with a first presser roller 16, a second presser roller 19 capable of being re-positioned at a position downstream from the first presser roller as seen in the applying direction of an adhesive tape, a second guide roller 27 rotatable about an axis transverse to rotary axes of a pair of first guide rollers disposed in parallel to the first and second presser rollers 16, 19 and rotary axes of the first and second presser rollers 16, 19, a third guide roller 29 capable of being repositioned in an offset state at an upstream position in the applying direction of the adhesive tape, a tape guide plate 34 pivoted at a proximal end thereof, and holding elements 37, 38 for defining a rotational position of the tape guide plate 34, whereby the adhesive tape can be easily, quickly and accurately applied to a predetermined position in either of a right or left door sash.

15 Claims, 7 Drawing Sheets

TAPE APPLICATION DEVICE

TECHNICAL FIELD

The present invention relates to a tape application device for applying a strip-like adhesive tape released from a release paper along a tape-applying surface of a workpiece on which the adhesive tape is to be applied.

BACKGROUND ART

It is desirable to color inner and outer sides of a door sash of an automotive vehicle with matte black because a light reflection from the door sash is minimized when viewed from the outside the vehicle, particularly from a lateral side of a vehicle body, which results in the neat appearance of not only a vehicle cabin but also the entirety of the vehicle body.

Thus, the spray painting of matte black paint to a door sash has conventionally been carried out. The spray painting, however, is problematic in that incidental facilities for maintaining a working environment in a favorable condition is expensive and a longer time is necessary for drying the paint. To eliminate such problems, the use of matte black adhesive tape resistant to weather and wear is proposed, for example, in Japanese Patent Application Laying-open Nos. 51-135015 (1976) and 62-46780 (1987), which is applied to the door sash instead of the spray painting of paint. In this case, since the vehicle door sash is primarily constituted by three-dimensional curvatures as is well-known, a device for carrying out the above-mentioned attachment of the adhesive tape would become extremely large and elaborate, which will rise an installation cost of a production line if such the device were actually incorporated thereinto. Also, the device is poor in adaptability to the design change of the door sash and lacks a general-purpose property.

When this applying operation is manually carried out by the operator in a vehicle production line without using any jigs, an extremely high level of operational skill will be required for accurately performing the operation at a speed in correspondence to that of the vehicle production line. Another tape application device is proposed, for example, in Japanese Patent Application Laying-open No. 5-338627 (1993), which allows the operator with ordinary skill to easily and quickly perform the above-mentioned operation. By using this tape application device, it is possible to easily and quickly apply the adhesive tape at a predetermined position on the door sash in a precise manner even by an ordinary operator not highly skill in the art.

Also, it is deemed that a device for automatically incorporating a weather strip into a door sash may be usable, which is disclosed, for example, in Japanese Patent Application Laying-open Nos. 2-221582 (1990) and 3-166068 (1991) and Japanese Patent Application Publication No. 5-65298 (1993).

A further tape application device disclosed in Japanese Patent Application Laying-open No. 5-338627 (1993) is adapted for either a right-hand or left-hand specification in correspondence to right and left doors of a vehicle, respectively. Therefore, in a sedan type passenger vehicle with four doors, it is necessary to use four kinds of tape application devices in correspondence to front and rear doors on the right and left sides, which is very troublesome. In addition, this device is complicated in structure, resulting in the inconvenience in that the number of parts becomes large and the production cost increases.

If the weather strip attachment device disclosed, for example, in Japanese Patent Application Laying-open Nos. 2-221582 (1990) and 3-166068 (1991) and Japanese Patent Application Publication No. 5-65298 (1993) is used as a tape application device, a problem may occur in that a space is necessary for installing a manipulator in addition to devices for holding and positioning the door panel, which requires a change in vehicle production line.

DISCLOSURE OF THE INVENTION

An object of the present invention is to provide a tape application device at a lower cost, which allows an ordinary operator not highly skill in the art to quickly and accurately attach an adhesive tape at a predetermined position either on a right door sash or on a left door sash.

A tape application device according to the present invention is detachably mounted to a workpiece, for applying an adhesive tape released from a release paper onto a tape applying surface provided on the workpiece, comprises a main body, a sub body spaced from the main body, a first presser roller rotatably supported between the main body and the sub body, so that the adhesive tape is wrapped therearound, a second presser roller disposed in parallel to the first presser roller and capable of being re-positioned relative to the main body and the sub body to be located downstream from the first presser roller as seen in the applying direction of the adhesive tape, a first guide roller mounted to the main body to be rotatable about an axis generally parallel to rotary axes of the first and second presser rollers, a second guide roller mounted to the main body to be rotatable about an axis transverse to the rotary axis of the first guide roller and the rotary axes of the first and second presser rollers, for holding the main body in association with the first guide roller to be movable along the tape applying surface while being engaged therewith so that the first and second guide rollers roll on the tape applying surface while being pressed thereon, a third guide roller disposed in parallel to the second guide roller, for holding the main body in association with the second guide roller and the first guide roller to be movable along the tape applying surface while being engaged therewith so that the first and second presser rollers roll on the tape applying surface while being pressed thereon, and capable of being re-positioned relative to the main body to be disposed in an offset state upstream in the applying direction of the adhesive tape with respect to the first presser roller, a tape guide plate pivoted at a proximal end thereof to the sub body to be rotatable about an axis vertical to the rotary axes of the first and second presser rollers and the second and third guide rollers, and holding means disposed between a distal end of the tape guide plate and the main body, for holding the tape guide plate so that a gap for guiding the adhesive tape-cum-release paper is formed on a side opposite to the second guide roller relative to the presser roller in a manner such that the presser roller is positioned between the second guide roller and the gap.

In the tape application device of the present invention, after a tip end of the adhesive tape has been applied to the predetermined position of the tape applying surface on the workpiece, the main body is engaged with the workpiece by the first to third guide rollers so that the adhesive tape is pressed onto the tape applying surface by the first and second presser roller. And, after the adhesive tape has been wrapped around the first presser roller and transferred to the second presser roller, the tape guide plate is stationary relative to the main body by the holding means to define the gap between the presser rollers and the tape guide plate so that the adhesive tape-cum-release paper is located therein. When the main body moves from this state along the tape applying surface, the adhesive tape released from the release paper is pressed onto the tape applying surface by means of the first and second presser rollers and applied thereto.

According to the tape application device of the present invention, since the second presser roller and the third guide roller can be re-positioned in accordance with the applying directions of the adhesive tape, it is possible to apply this device to, for example, a workpiece of either a left-hand or right-hand specification. Also, since this device is simple in structure, it can be produced at a lower cost. Since the third guide roller is disposed in an offset state at a position upstream in the applying direction of the adhesive tape with respect to the first presser roller, the moving direction of the tape application device is easily controlled along the workpiece so that the tape application device is always tightly engaged with the workpiece without looseness. As a result, it is possible to accurately apply the adhesive tape onto the tape-applying surface of the workpiece even by a non-skilled operator. Particularly, since the first and second presser rollers and the first and second guide rollers roll on the workpiece during the movement of the tape application device along the workpiece, there is less frictional resistance against the movement of the tape application device relative to the workpiece, whereby the tape-adhesion operation can be performed with a smaller force without any damage on the surface of the adhesive tape due to the friction.

In the tape application device according to the present invention, two positions may be defined for mounting the second presser roller in the main body and the sub body so that the second presser roller is mounted to either one of the two positions. In such a case, the first presser roller may be disposed between the two positions for mounting the second presser member.

The repositioning of the second presser roller may be carried out by the detachment/attachment of the second presser roller relative to the main body and the sub body.

Alternatively, the re-positioning of the second presser roller may be carried out by the rotary motion of the second presser roller about a rotary axis of the first presser roller. In such a case, the device may further include a pivot for coupling the main body with the sub body and passing through the first presser member to rotatably support the latter, and a rotary arm rotatably connected at a proximal end thereof with the pivot and carrying the second presser member at a tip end of thereof in a rotatable manner. In such a case, the device may further includes two sets of stoppers provided in at least one of the main body and the sub body for defining two rotational positions of the rotary arm relative to the pivot. Thus, it is possible to quickly carry out the re-positioning of the second presser roller and facilitate the operation to a great extent.

Two positions may be defined for mounting the third guide roller in the main body so that the third guide roller is mounted to either one of the two positions. In such a case, the second guide roller may be disposed between the two positions for mounting the third guide rollers. Also, the re-positioning of the third guide roller may be carried out by the detachment/attachment of the third guide roller relative to the main body.

The device may further include ribs provided in the tape guide plate, projected into the gap at positions on opposite sides of the first presser roller as seen in the rotational direction thereof. In such a case, one of the ribs may project between the first and second presser rollers.

An outer circumferential surface of the first and second presser rollers may be formed of elastomeric material. In such a case, the adhesive tape can be evenly applied to the tape-applying surface without involvement of air.

The device may have a plurality of second guide rollers.

The holding means may be one using magnetic force. In such a case, the holding means becomes compact in size and is capable of quickly and easily carrying out the opening/closing operation of the tape guide plate.

The above and other objects, effects, features, and advantages of the present invention will become more apparent from the following description of embodiments thereof taken in conjunction with the accompanying drawings.

BEST MODE FOR CARRYING OUT THE INVENTION

A tape application device according to the present invention will be described in detail below with reference to FIGS. 1 through 7 illustrating embodiments applied to a front door outer sash or a rear door outer sash of a passenger vehicle. The present invention, however, should not be limited to these embodiments, and includes the combination thereof or the application to other technical field involved in similar problems.

Figure 1:
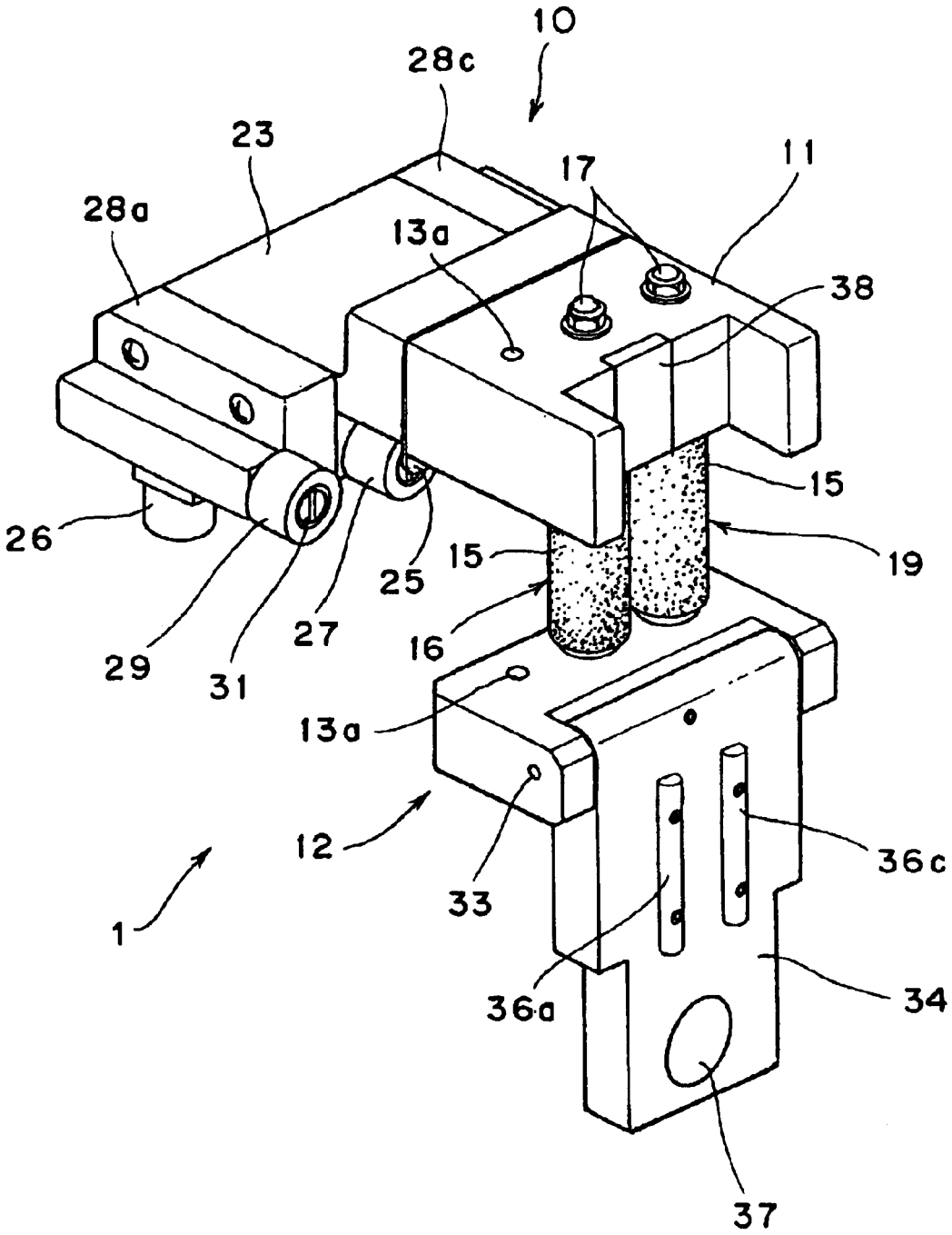
FIG. 1 is a perspective view showing an appearance of one embodiment of a tape application device according to the present invention, which is applicable to a door outer sash for a passenger vehicle.
Figure 2:
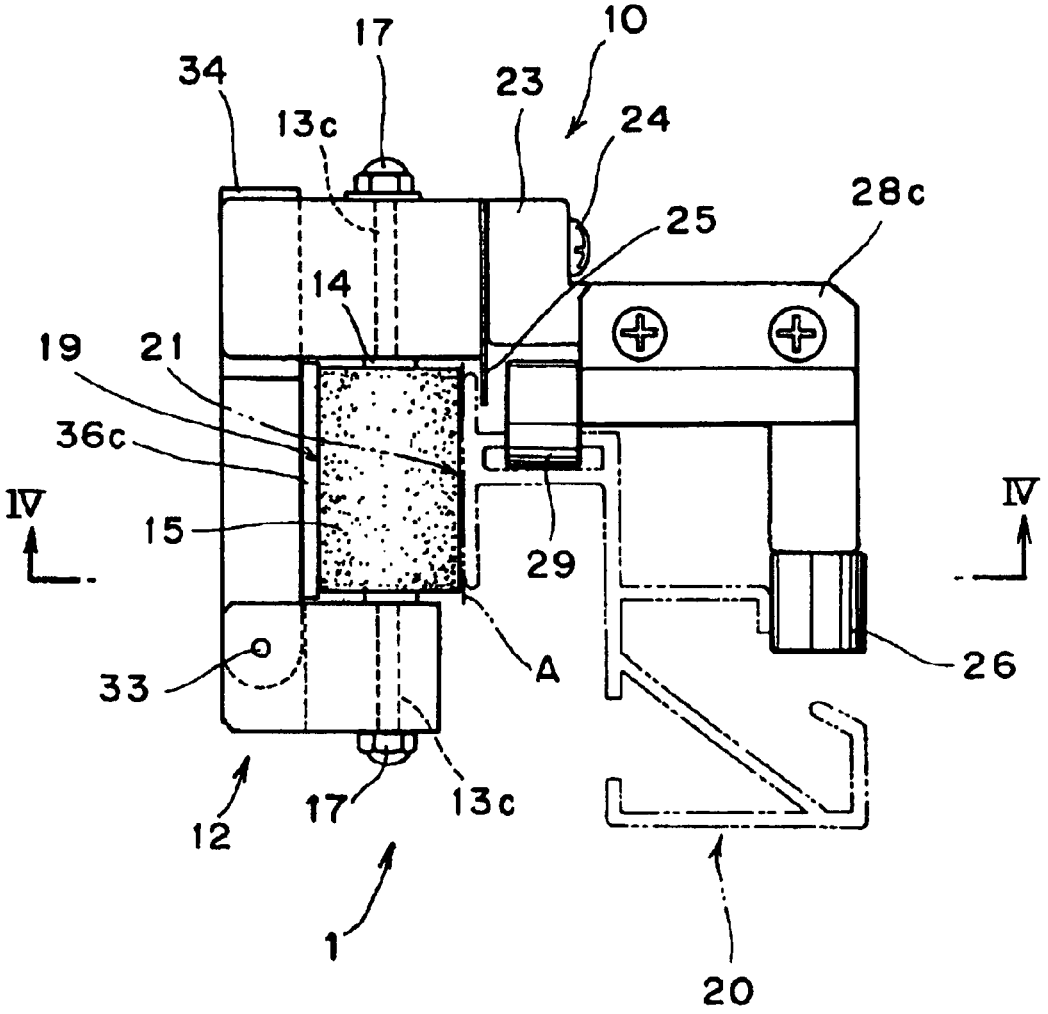
FIG. 2 is a partially sectional side view of the embodiment shown in FIG. 1.
Figure 3:
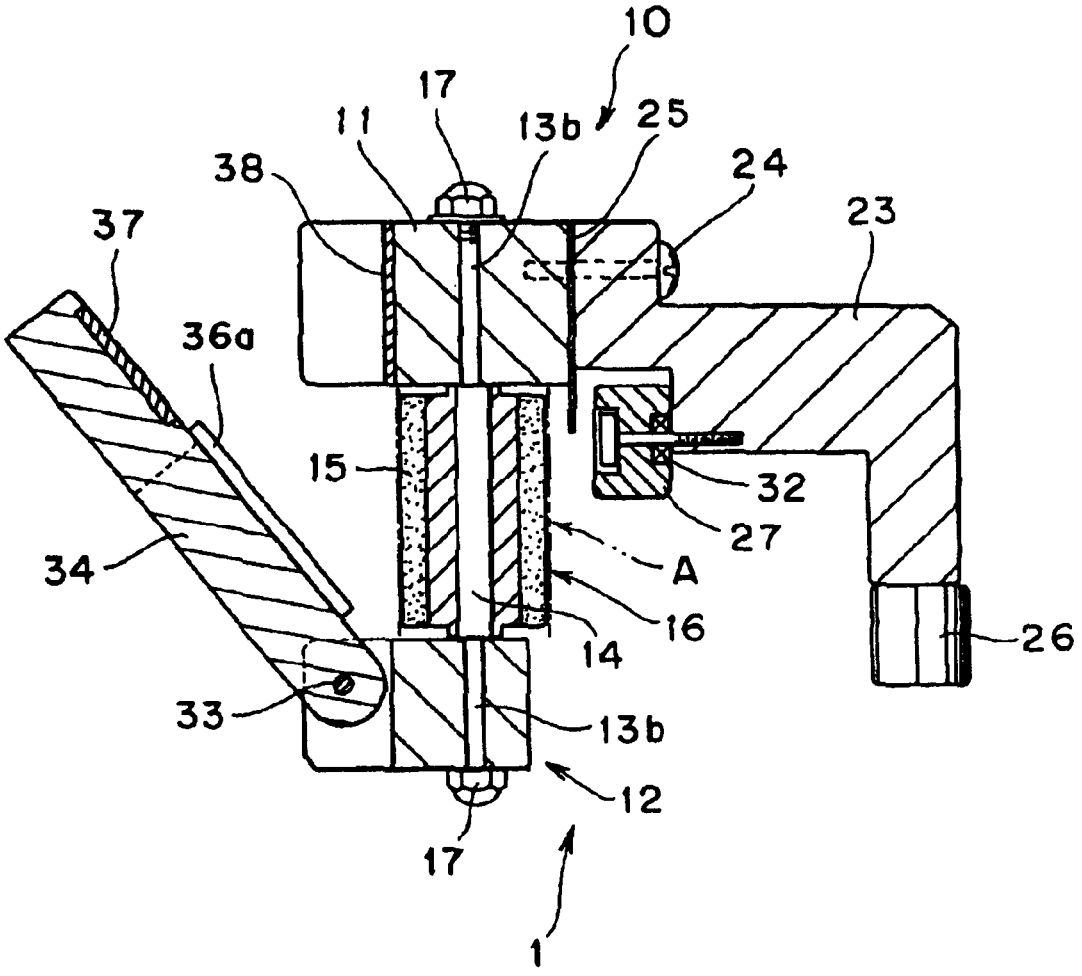
FIG. 3 is a sectional view corresponding to FIG. 2, showing an internal structure of the embodiment shown in FIG. 1.
Figure 4:
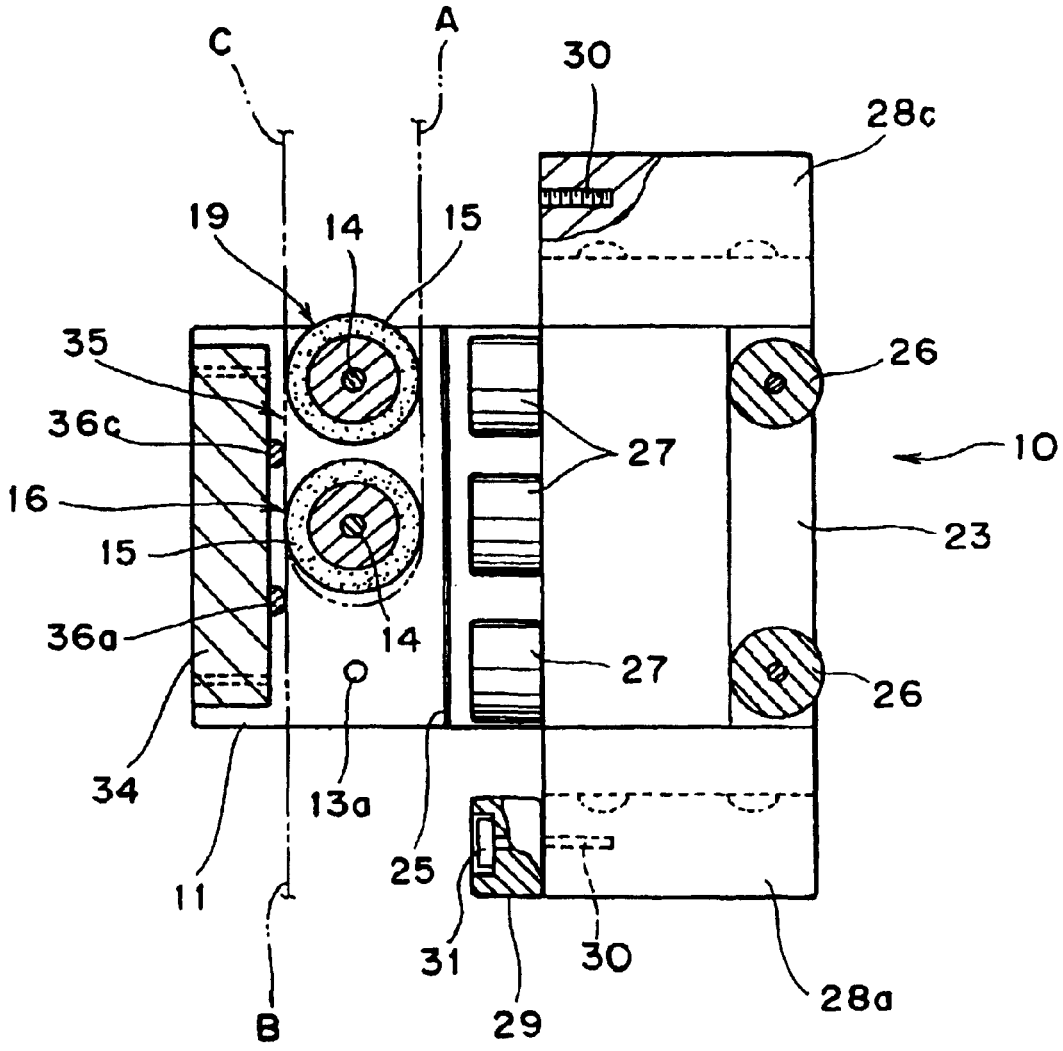
FIG. 4 is a sectional view taken along a line IV—IV in FIG. 2.
Figure 5:
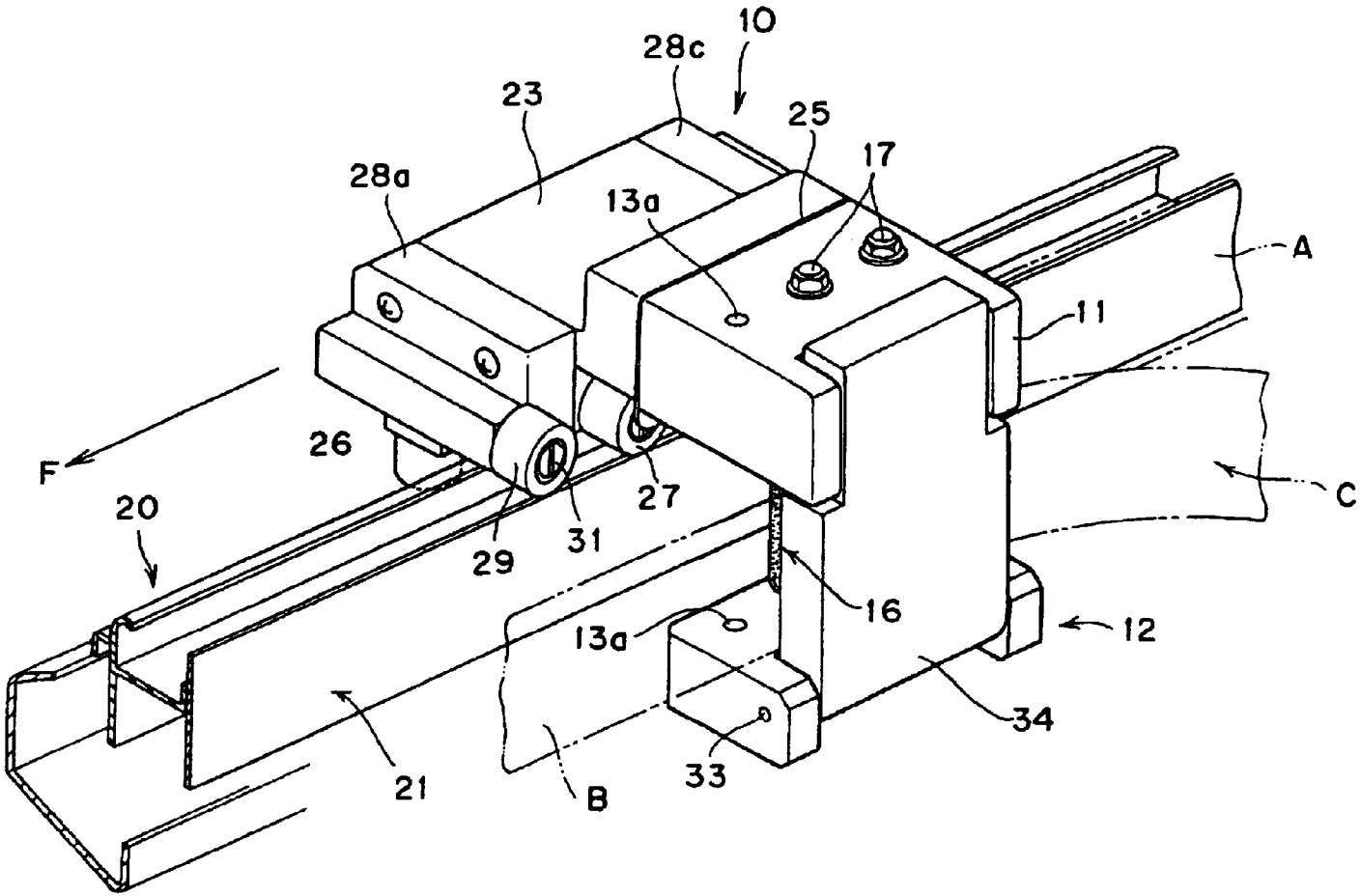
FIG. 5 is a perspective view of the tape application device shown in FIG. 1, which is coupled to the door outer sash.

FIG. 1 illustrates an appearance of an embodiment in which a tape guiding plate is open; FIG. 2 illustrates a side appearance thereof; FIG. 3 illustrates a sectional shape thereof; FIG. 4 illustrates a sectional shape taken along a line IV—IV; and FIG. 5 illustrates an appearance of the tape application device according to this embodiment coupled to a front door outer sash or a rear door outer sash (hereinafter merely referred to as a door outer sash) used as a workpiece.

Three sets of bolt-through holes 13*a*, 13*b* and 13*c* are provided at a predetermined interval in a presser roller bracket 11 and a sub body 12 constituting part of a main body 10. A roller supporting connecting bolt 14 is inserted into middle ones 13*b* of the bolt-through holes in the presser roller bracket 11 and the sub body 12. The roller supporting connecting bolt 14 passes through an additional presser roller (a first presser roller) 16 on the outer circumference of which is covered with an elastomeric material 15 to hold the same in a rotatable manner. The presser roller bracket 11 and the sub body 12 are fastened together by lock nuts 17 screw-engaged with opposite ends of the bolt while interposing the roller supporting connecting bolt 14 and the additional presser roller 16 between the both. It is necessary to properly match a distance between the presser roller bracket 11 and the sub body 12 with a length of the additional presser roller 16 and a width of an adhesive tape A. For this purpose, a middle portion of the roller supporting connecting bolt 14; i.e., a portion to be fit into the additional presser roller 16; has an outer diameter larger than an inner diameter of the bolt-through hole 13*b* to define shoulders at opposite ends thereof, whereby the distance between the presser roller bracket 11 and the sub body 12 generally corresponds to a length of the larger diameter portion.

As described later, the additional presser roller 16 operates to release a release paper B from an adhesive tape A by wrapping the adhesive tape A therearound. In view of favorably keeping the releasability of the adhesive tape A from the release paper B, an outer diameter of the additional presser roller 15 is preferably as small as possible.

Another presser roller supporting connecting bolt 14 is inserted into one bolt-through hole 13*c*, provided in the presser roller bracket 11 and the sub body 12, of the remaining two bolt-through holes 13*a*, 13*c*, located downstream of the additional presser roller 16 as seen in the applying direction of the adhesive tape A. This roller supporting connecting bolt 14 passes through a main presser roller (a second presser roller) 19 on the outer circumference of which is covered with an elastomeric material 15 to hold the same in a rotatable manner. The presser roller bracket 11 and the sub body 12 are fastened together by lock nuts 17 screw-engaged with opposite ends of the bolt while interposing the roller supporting connecting bolt 14 and the main presser roller 19 between the both. The main presser roller 19 has substantially the same basic structure as that of the additional presser roller 16, except that the outer diameter thereof is somewhat larger than that of the additional presser roller 16. Accordingly, a pressing force becomes larger against a tape applying surface 21 of a door outer sash 20 in comparison with the additional presser roller 16, which allows the adhesive tape A to be assuredly brought into tight contact with the tape applying surface 21 of the door outer sash 20 even though the tape applying surface 21 of the door outer sash 20 is somewhat curved in the direction opposing the additional presser roller 16 and the main presser roller 19.

As stated later, in the use of this tape application device 1, the adhesive tape A is wrapped half around the additional presser roller 16 and the main presser roller 19 so that an adhesive surface is directed outward. Contrarily, the release paper B holding the adhesive tape A is withdrawn from the tape application device 1 along the door outer sash 20.

A guide roller bracket 23 constituting part of the main body 10 is fixedly secured to the presser roller bracket 11 via connecting screws 24. A flexible pressing plate 25 is gripped between the guide roller bracket 23 and the presser roller bracket 11, for nipping a panel member defining the tape applying surface 21 of the door outer sash 20 in association with the additional presser roller 16 and the main presser roller 19. A pair of first guide rollers 26 capable of being in contact with lateral inner sides opposite to the tape applying surface 21 and a plurality of (three in the illustrated embodiment) second guide rollers 27 engageable with a weather strip attachment section are mounted to the guide roller bracket 23 in a rotatable manner.

Additional brackets 28*a*, 28*c* are provided on the opposite sides of the guide roller bracket 23, respectively, along the arrangement direction of the second guide rollers 27. Threaded holes 30 are formed in the additional brackets 28*a*, 28*c*, respectively, for mounting third guide rollers 29 arranged in parallel to the second guide rollers 27. The third guide roller 29 is attached in a replaceable manner by a fastening screw 31 to the threaded hole 30 in the additional bracket 28*a* located upstream in the applying direction of the adhesive tape A.

Each of the guide rollers 26, 27, 29 is formed of a resinous polymeric material and has a bearing 32 (see FIG. 3) to minimize the rotational wear due to the displacement of the tape application device 1 relative to the door outer sash 20. In the present embodiment, the presser roller bracket 11, the guide roller bracket 23 and the additional brackets 28*a*, 28*c* constitute the main body 10 (see FIG. 4).

A rotary axis of the first guide roller 26 is defined generally parallel to rotary axes of the additional presser roller 16 and the main presser roller 19. A rotary axis of the second guide roller 27 is defined generally vertical to the rotary axes of the first guide roller 26, the additional presser roller 16 and the main presser roller 19. However, it is possible to appropriately change such a layout in accordance with shapes of the door outer sash 20. Alternatively, when the width and/or the shape of the door outer sash 20 are variable due to the difference of vehicle types or others, the first guide roller 26 and the second guide roller 27 may be replaced with those having different shapes and/or sizes so that the versatility of the device is maintained to some extent.

According to this embodiment, when the tape application device 1 is set to the door outer sash 20 in a proper state as shown in FIG. 2, the door outer sash 20 is nipped between the additional presser roller 16, the main presser roller 19 and the first guide rollers 26, and the panel member defining the tape applying surface 21 of the door outer sash 20 is nipped between the additional presser roller 16, the main presser roller 19 and the pressing plate 25 so that the additional presser roller 16 and the main presser roller 19 are forced against the tape applying surface 21.

A pivot pin 33 disposed vertically to the roller supporting connecting bolt 14 and generally in parallel to the tape applying surface 21 is rotatably supported at opposite ends thereof on the sub body 12. A tape guide plate 34 fixed to the pivot pin 33 passing through a proximal end thereof is rotatable relative to the sub body 12 about the pivot pin 33 between an open position shown in FIG. 1 and a closed position shown in FIG. 2. The tape guide plate 34 is disposed opposite to the second guide roller 27 while interposing the additional presser roller 16 and the main presser roller 19 between the both. At the closed position, a gap 35 is formed between the tape guide plate 34 and the pair of additional and main presser rollers 16, 19, for allowing an adhesive tape-cum-release paper C to pass therethrough. When the tape application device 1 is properly set to the door outer sash 20 as shown in FIG. 2, the tape guide plate 34 is located generally in parallel to the tape applying surface 21.

A pair of ribs 36*a* and 36*c* are provided on the tape guide plate 34 to project into the gap 35 at positions on the opposite sides of the additional presser roller 16 as seen in the rotational direction thereof, when the tape guide plate 34 is at the closed position. Since one rib 36*c* is positioned between the additional presser roller 16 and the main presser roller 19, it is possible to impart a suitable tension to the adhesive tape A.

To keep the tape guide plate 34 at the closed position, a permanent magnet 37 is embedded in a distal end portion of the tape guide plate 34 (see FIG. 3). A mild steel plate 38 is embedded in the presser roller bracket 11 opposite to the tape guide plate 34 so that a holding means according to the present invention is formed of the permanent magnet 37 and the mild steel plate 38. Attraction operated between the both due to magnetic force is preferably to such an extent that the operator could easily separate the one from the other. Instead of using the magnetic force as in this embodiment, other means may, of course, be adopted as means for holding the tape guide plate 34 at the closed position.

In the actual operation, the mounting position of the main presser roller 19 and the third guide roller 29 is changed in accordance with the moving directions of the tape application device 1 relative to the tape applying surface 21 of the door outer sash 20. For example, in a state shown in FIG. 5, if the tape application device 1 moves toward this side as seen in the drawing (in the arrowed direction F in FIG. 5) relative to the tape applying surface 21 of the door outer sash 20, the above-mentioned layout could be adopted as it is. Contrarily, if it is necessary to move the device in the reverse direction, the lock nuts 17 (see FIG. 3) are unfastened from the roller supporting connecting bolt 14 to remove the latter and the main presser roller 19 from the presser roller bracket 11 and the sub body 12, then, the roller supporting connecting bolt 14 carrying the main presser roller 19 thereon is inserted into the non-used bolt-through holes 13*a* and thereafter, fastened again by the lock nuts 17. At the same time, the fastening screw 31 is removed, together with the third guide roller 29 (see FIG. 4), from the additional bracket 28*a* carrying the third guide roller 29, and mounted to the other additional bracket 28*c* on which no third guide roller 29 has been carried.

After a tip end of the release paper B is released from the adhesive tape-cum-release paper C, a tip end of the adhesive tape A is applied to a predetermined position in a flat portion of the tape applying surface 21 of the door outer sash 20 (generally referred to as an application-start position). Thereafter, the tape guide plate 34 of the tape application device 1 re-positioned to a proper position in advance as described before is made open as shown in FIG. 1, and the first guide roller 26 and the second guide roller 27 are engaged with the door outer sash 20 so that the additional presser roller 16 and the main presser roller 19 press the tip end of the adhesive tape A onto the tape applying surface 21.

Then, the adhesive tape A is wrapped half around the additional presser roller 16 and the release paper B is made to extend generally in parallel to the tape applying surface 21 while pressing the additional presser roller 16 and the main presser roller 19. And the tape guide plate 34 is fixed to the closed position as shown in FIGS. 2 and 5.

In this case, according to the present invention, since the pivot pin 33 is attached to the sub body 12 so that the tape guide plate 34 is suspended downward from the sub body 12 to keep the open position, it is unnecessary for the operator to hold the tape guide plate 34 at the open position when the adhesive tape A is wrapped around the additional presser roller 16 and the main presser roller 19. Thereby, it is possible to favorably maintain the above-mentioned operability.

From this state, the operator moves the tape application device 1 leftward as seen in FIG. 5 along the tape applying surface 21 while releasing the adhesive tape A from the adhesive tape-cum-release paper C. The adhesive tape A is pressed onto the tape applying surface 21 with the aid of the elastic deformation of the additional presser roller 16 and the main presser roller 19, while restricting the deviation thereof from the tape applying surface 21 by the gap 35, to be smoothly applied to the tape applying surface 21. At the same time, the used release paper B is being pushed out forward in the moving direction of the tape application device 1.

In this case, since an outer diameter of the additional presser roller 16 is limited to an allowable minimum value in this embodiment, the adhesive tape A is assuredly releasable from the release paper B. In addition, since an outer diameter of the main presser roller 19 is selected to be larger than that of the additional presser roller 16, the adhesive tape A is temporarily applied to the tape applying surface 21 with the additional presser roller 16 while being accurately positioned relative to the tape applying surface 21, and then firmly and assuredly pressed onto the tape applying surface 21.

If the positions of the bolt-through holes 13*a*, 13*c* for the roller supporting connecting bolt 14, by which the main presser roller 19 attached, are provided closer to the tape applying surface 21 of the door outer sash 20 than that of the bolt-through hole 13*b* for the additional presser roller 16, the same effect as described above will be obtained even though the outer diameter of the main presser roller 19 is smaller than that of the additional presser roller 16.

The main body 10 engages with the door outer sash 20 without looseness in conformity therewith by means of the first guide rollers 26, the second guide rollers 27.and the third guide roller 29. Since these guide rollers 26, 27 and 29 are formed of material with a low frictional coefficient, the frictional resistance becomes small when the tape application device 1 moves along the tape applying surface 21 of the door outer sash 20 to facilitate the applying operation. Since the third guide roller 29 exists, the moving direction of the tape application device 1 is easily controlled to conform with the tape applying surface 21, which enhances the operability of the tape application device 1 during the displacement.

After the adhesive tape A has been applied to the tape applying surface 21 of the door outer sash 20 in such a manner, the tape application device 1 is detached from the tape applying surface 21 of the door outer sash 20, and widthwise opposite edges of the adhesive tape A are applied to the remaining part of the door outer sash 20 by using a squeezing device not shown. Since the adhesive tape A has already been accurately positioned relative to the door outer sash 20 in this stage, the operation can be carried out with no problems.

Although the main presser roller 19 is re-positioned by unfastening the lock nuts 17 in the above embodiment, it is possible to adopt a mechanism for re-positioning the main presser roller 19 in a one-touch manner.

Figure 6:
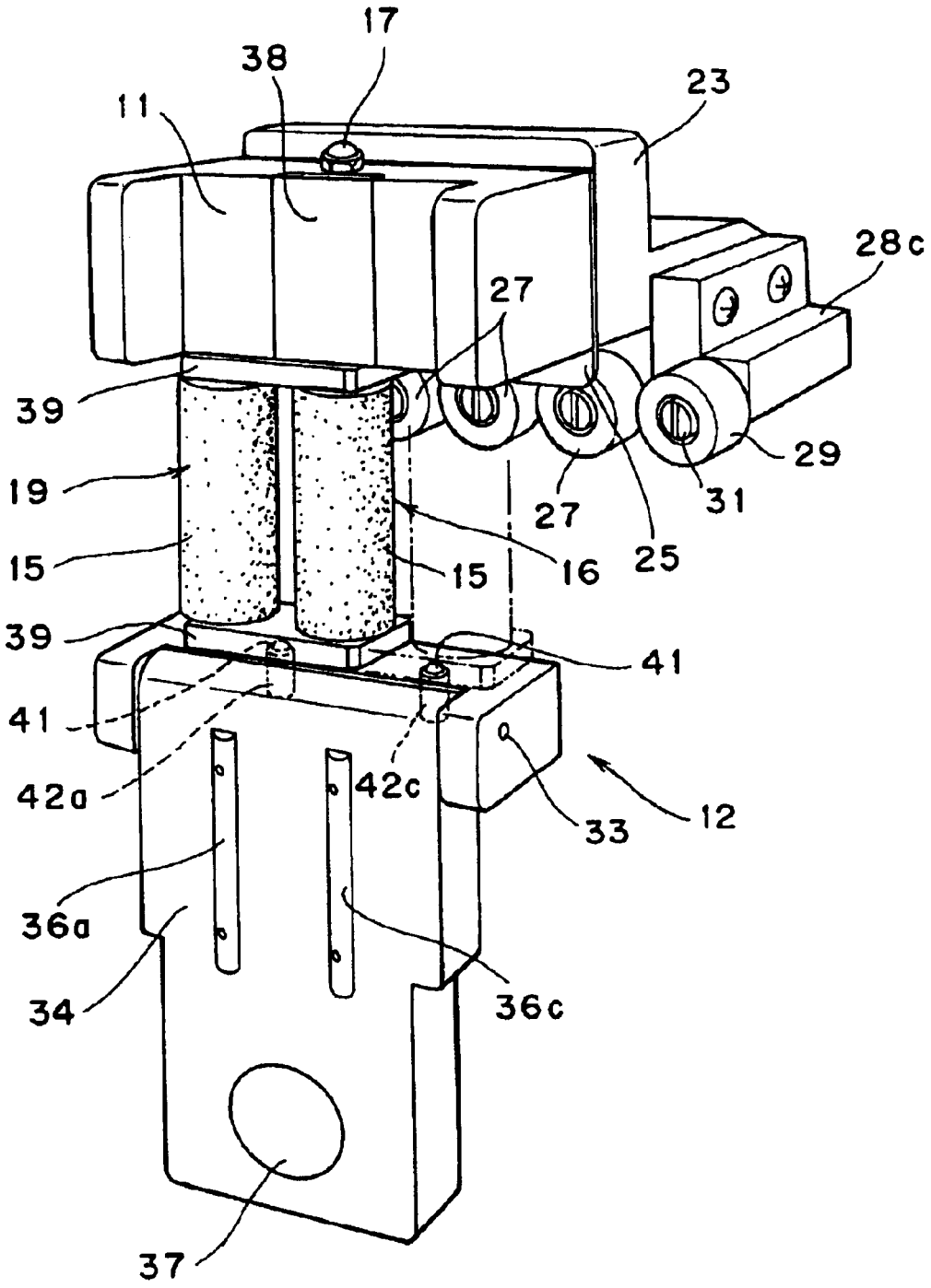
FIG. 6 is a perspective view showing a schematic structure of another embodiment of a tape application device according to the present invention.
Figure 7:
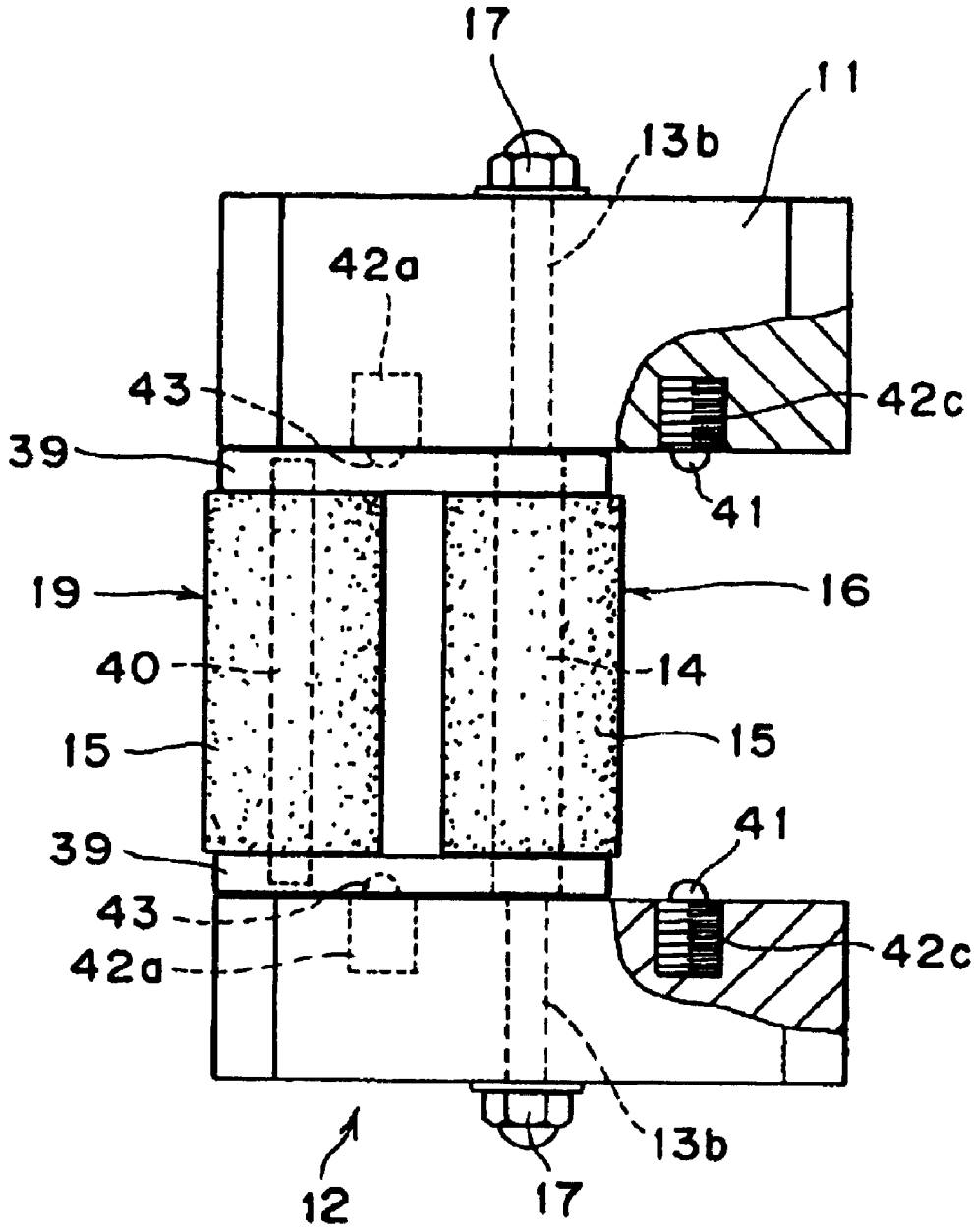
FIG. 7 is a partially sectional front view of a primary portion of the embodiment shown in FIG. 6.

FIG. 6 shows an appearance of other embodiment of such a tape application device according to the present invention and FIG. 7 shows a partially sectional view of a primary portion thereof. In this regard, the same reference numerals are used for denoting elements having the same function as those in the preceding embodiment, and the explanation thereof will be eliminated. A pair of rotary arms 39 are pivoted at proximal ends thereof to a roller supporting connecting bolt 14 at positions between one of longitudinal opposite ends of the additional presser roller 16, and between the other end and the sub body 12. The main presser roller 19 is rotatably fitted to a pin 40 coupled at opposite ends thereof to a distal ends of the pair of rotary arms 39.

To restrict the position of the main presser roller 19 via the rotary arms 39, two sets of ball plungers 42*a*, 42*c*, each incorporating a ball 41 capable of being in or out due to the elastic force, are embedded in the presser roller bracket 11 and the sub body 12, respectively. The ball 41 at the tip end of the ball plunger 42*a* or 42*c* is biased to partially project above a surface of the presser roller bracket 11 or the sub body 12. In correspondence to these ball plungers 42*a*, 42*c*, a pair of recesses 43 are provided in the rotary arms 39, respectively, to be engageable with the balls 41 at the tip end of the ball plungers 42*a*, 42*c*.

These two ball plungers 42*a*, 42*c* and the pair of recesses 43 function as two stoppers according to the present invention. That is, if it is necessary to reposition the main presser roller 19, the main presser roller 19 is made to rotate together with the rotary arms 39 from a stage shown in FIG. 7, about the roller supporting connecting bolt 14 by 180 degrees to engage a tip end of the other ball plunger 42*a* with the recess 43 of the rotary arm 39. Thus, the re-positioning of the main presser roller 19 is easily and quickly achievable.

Although the position of the third guide roller 29 is changed relative to the pair of additional brackets 28*a*, 28*c* in the above-mentioned two embodiments, it may be possible to shift the entirety of the second guide roller 29 and the third guide rollers 27 in the arrangement direction thereof when the applying direction of the adhesive tape A is reversed. In summary, any structure may be adopted to carry out the re-positioning of the respective rollers 19, 29.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

INDUSTRIAL APPLICABILITY

The tape application device according to the present invention is capable of easily and quickly carry out the operation for applying a strip-like adhesive tape while releasing a release paper therefrom to a door outer sash of a vehicle or others.

What is claimed is:

1. A tape application device detachably mounted to a workpiece, for applying an adhesive tape released from a release paper onto a tape applying surface provided on the workpiece, comprising a main body;

a sub body spaced from the main body;

a first presser roller rotatably supported between the main body and the sub body, so that the adhesive tape is wrapped therearound;

a second presser roller disposed in parallel to the first presser roller and capable of being re-positioned relative to the main body and the sub body to be located downstream from the first presser roller as seen in the applying direction of the adhesive tape;

a first guide roller mounted to the main body to be rotatable about an axis generally parallel to rotary axes of the first and second presser rollers;

a second guide roller mounted to the main body to be rotatable about an axis transverse to the rotary axis of the first guide roller and the rotary axes of the first and second presser rollers, for holding the main body in association with the first guide roller to be movable along the tape applying surface while being engaged therewith so that the first and second guide rollers roll on the tape applying surface while being pressed thereon;

a third guide roller disposed in parallel to the second guide roller, for holding the main body in association with the second guide roller and the first guide roller to be movable along the tape applying surface while being engaged therewith so that the first and second presser rollers roll on the tape applying surface while being pressed thereon, and capable of being re-positioned relative to the main body to be disposed in an offset state upstream in the applying direction of the adhesive tape with respect to the first presser roller;

a tape guide plate pivoted at a proximal end thereof to the sub body to be rotatable about an axis vertical to the rotary axes of the first and second presser rollers and the second and third guide rollers; and holding means disposed between a distal end of the tape guide plate and the main body, for holding the tape guide plate so that a gap for guiding the adhesive tape-cum-release paper is formed on a side opposite to the second guide roller relative to the presser roller in a manner such that the presser roller is positioned between the second guide roller and the gap.

2. A tape application device as claimed in claim 1, wherein two positions are defined for mounting the second presser roller in the main body and the sub body so that the second presser roller is mounted to either one of the two positions.

3. A tape application device as claimed in claim 2, wherein the first presser roller is disposed between the two positions for mounting the second presser member.

4. A tape application device as claimed in any one of claims 1 to 3, wherein the re-positioning of the second presser roller is carried out by the detachment/attachment of the second presser roller relative to the main body and the sub body.

5. A tape application device as claimed in any one of claims 1 to 3, wherein the re-positioning of the second presser roller is carried out by the rotary motion of the second presser roller about a rotary axis of the first presser roller.

6. A tape application device as claimed in claim 5, wherein the device further comprises a pivot for coupling the main body with the sub body and a rotary arm rotatably connected at a proximal end thereof with the pivot; the pivot passing through the first presser member to rotatably support the latter, and the second presser member being rotatably mounted to a tip end of the rotary arm.

7. A tape application device as claimed in claim 6, wherein the device further comprises two sets of stoppers provided in at least one of the main body and the sub body for defining two rotational positions of the rotary arm relative to the pivot.

8. A tape application device as claimed in any one of claims 1 to 3, wherein two positions are defined for mounting the third guide roller in the main body so that the third guide roller is mounted to either one of the two positions.

9. A tape application device as claimed in claim 8, wherein the second guide roller is disposed between the two positions for mounting the third guide rollers.

10. A tape application device as claimed in claim 8, wherein the repositioning of the third guide roller is carried out by the detachment/attachment of the third guide roller relative to the main body.

11. A tape application device as claimed in any one of claims 1 to 3, wherein the device further comprises ribs provided in the tape guide plate, projected into the gap at positions on opposite sides of the first presser roller as seen in the rotational direction thereof.

12. A tape application device as claimed in claim 11, wherein one of the ribs projects between the first and second presser rollers.

13. A tape application device as claimed in any one of claims 1 to 3, wherein an outer circumferential surface of the first and second presser rollers is formed of elastomeric material.

14. A tape application device as claimed in any one of claims 1 to 3, wherein the device has a plurality of second guide rollers.

15. A tape application device as claimed in any one of claims 1 to 3, wherein the holding means is one using magnetic force.

* * * * *